US009605924B1

(12) United States Patent
McCaslin

(10) Patent No.: US 9,605,924 B1
(45) Date of Patent: Mar. 28, 2017

(54) COMPRESSED GAS GUN WITH IMPROVED OPERATING MECHANISM

(71) Applicant: John A. McCaslin, Johnson County, TX (US)

(72) Inventor: John A. McCaslin, Johnson County, TX (US)

( * ) Notice: Subject to any disclaimer, the term of this patent is extended or adjusted under 35 U.S.C. 154(b) by 21 days.

(21) Appl. No.: 14/919,900

(22) Filed: Oct. 22, 2015

(51) Int. Cl.
*F41B 11/70* (2013.01)
*F41B 11/62* (2013.01)
*F41B 11/723* (2013.01)

(52) U.S. Cl.
CPC ..... *F41B 11/70* (2013.01); *F41B 11/62* (2013.01); *F41B 11/723* (2013.01)

(58) Field of Classification Search
CPC ..... F41B 11/00; F41B 11/62; F41B 11/643; F41B 11/70; F41B 11/723
USPC ..... 124/63–66, 70, 71, 73, 74
See application file for complete search history.

(56) References Cited

U.S. PATENT DOCUMENTS 1,897,226 A * 2/1933 Anson ..... F41B 11/647 124/67
2,605,756 A * 8/1952 Bertschinger ..... F41A 11/02 124/37
3,494,344 A 2/1970 Vadas et al.
3,542,008 A 11/1970 Vadas et al.
4,336,787 A * 6/1982 Cagnoni ..... F41B 11/68 124/69
4,539,969 A 9/1985 Saxby
5,224,465 A 7/1993 Milliman
5,257,614 A 11/1993 Sullivan
5,339,789 A * 8/1994 Heitz ..... F41C 23/06 124/56
5,383,442 A 1/1995 Tippmann
5,497,758 A 3/1996 Dobbins et al.
5,572,982 A 11/1996 Williams
5,586,545 A 12/1996 McCaslin
5,711,286 A 1/1998 Petrosyan et al.
5,813,392 A 9/1998 McCaslin
6,581,585 B2 * 6/2003 Nibecker, Jr. ..... F41B 11/723 124/69
8,905,012 B2 * 12/2014 Zafer ..... F41B 11/683 124/60

OTHER PUBLICATIONS

NPL: http://www.pyramydair.com/blog/2015/01/airforce-texan-big-bore-rifle-part-1/ Jan. 20, 2015.*

* cited by examiner

*Primary Examiner* — John D Cooper
(74) *Attorney, Agent, or Firm* — Dan Brown Law Office; Daniel R. Brown

(57) ABSTRACT

A compressed gas gun with a cocking mechanism that provides a mechanical advantage in compressing a main-spring, while providing a two stage loading and cocking action that accesses and seals a breech through utilization of an intermediate cocking member.

17 Claims, 6 Drawing Sheets

SECTION A-A

Loading

Cocked

Fired
18
4
34
38
26
36
40
42
43
44
60
30
14
32
6

COMPRESSED GAS GUN WITH IMPROVED OPERATING MECHANISM

BACKGROUND OF THE INVENTION

Field of the Invention

The present invention relates to compressed gas guns. More particularly, the present invention relates to compressed gas guns that employ a cocking mechanism, which yields a mechanical advantage for the compression of a main spring.

Description of the Related Art

Compressed gas guns operate to release a quantity of compressed gas into the breech of a barrel, which has been pre-loaded with a projectile, thereby propelling the projectile out of the barrel at high velocity. In practice, such a gun must provide a source of compressed gas in order to function. Typically, this source of gas is an air tank that is pre-charged prior to being coupled with the gun, or a fixed tank that is charged in place while coupled to the gun. As such, these are referred to as pneumatic pre-charged (PCP) guns. In either case, the tank holds a finite quantity of compressed gas. Upon discharging the gun one or more times, the reserve of compressed gas is ultimately depleted and must be replenished. Air is used as the compressed gas in the majority of PCP guns, but other suitable gases can be employed as well.

In the case of a manually loaded compressed gas gun, the breech of the barrel must be accessible for manual insertion of a projectile into the breech of the barrel. It is desirable to provide a readily accessible breech, which can be conveniently loaded by the fingers of the user. In the case of an auto-loading gun, the breech still must be accessible to the loading mechanism, yet sealable so as to coupled the compressed gas to the breech without undue gas leakage.

A valve mechanism is commonly provided which acts to discharge a quantity of compressed gas as a result of actuation of a trigger mechanism. However, prior to discharging the gun, the valve assembly must be coupled to the breech of the barrel in order to seal the gas port between the tank and the breech of the barrel. It is desirable to provide a pressure-tight seal, which serves to conserve the amount of gas consumed upon discharging the gun and also to conserve the pressure of the gas so as to maximize the amount of energy transferred from the compressed gas to the projectile. Furthermore, a tight gas seal reduces the sound level of the gun upon discharging, which is desirable in compressed gas guns.

The inventor of the present disclosure has been granted two prior patents, which are U.S. Pat. No. 5,586,545 issued on Dec. 24, 1996 for COMPRESSED GAS GUN, and U.S. Pat. No. 5,813,392 issued on Sep. 29, 1998 for COMPRESSED GAS GUN, which together disclose several embodiments of compressed gas guns. The entire disclosures of these two patents are hereby incorporated by reference. A review of those patents will reveal that the loading, cocking, and discharging mechanisms, collectively referred to as the operating assembly, incorporate a hammer and a mainspring where the compressed energy of the mainspring drives the hammer rearward in the receiver, and this energy is ultimately driven against a pneumatic valve to release a surge of compressed gas into the breech of a barrel to discharge the gun. It will also be noted that these designs were intended for lighter caliber projectiles, generally ranging from 0.17 inch to 0.25 inch calibers. The force of the main spring, weight of the hammer, and pneumatic valve actuation force are all related to the caliber and mass of the projectile. Since the forces required for lighter calibers are reasonable with respect to the force an operator must exert to compress the main spring, these prior design utilized a cocking lever that was directly coupled to the mechanism such that actuation of the cocking lever opened the breech seal, moved the hammer forward, and compressed the main spring in preparation of a subsequent discharge of the gun.

A growing trend in compressed gas guns is toward heavier caliber projectiles. Today, 0.30 inch caliber guns are known, and recently 0.45 inch caliber guns are entering the market. While the prior loading, cocking, and discharging mechanisms have performed well with lighter caliber guns, the higher forces required to discharge heavier calibers has correspondingly increased mainspring compressive forces, and the size and weight of related components, such that the operator applied cocking forces have become challenging for some operators. Thus it can be appreciated that there is a need in the art for a compressed gas gun that functions with heavier calibers, yet is manageable to operate.

SUMMARY OF THE INVENTION

The need in the art is addressed by the apparatuses of the present invention. The present disclosure teaches a compressed gas gun for discharging a projectile. In an illustrative embodiment, the compressed gas gun includes a barrel with a muzzle and breech, which is fixed to a receiver that supports a cocking pawl and a gas valve located adjacent to the breech. A cocking member slides in parallel with the barrel, and has a spring stop fixed thereto. A cocking lever is rotatably coupled to the receiver at a first end and coupled to the cocking member by a cocking link, and provides a mechanical advantage in sliding the cocking member. Opposing directions of rotation of the cocking lever urge the cocking member towards the muzzle or toward the breech. A breech seal slides together with the cocking member, and seals to the barrel adjacent to the breech. A hammer and a main spring are located between the breech seal and the spring stop. Rotation of the cocking lever to urge the cocking member toward the muzzle slides the breech seal away from the gas valve to facilitate insertion of the projectile into the breech, and also urges the hammer to engage the cocking pawl, thereby retaining the hammer. Further, rotation of the cocking lever to urge the cocking member toward the breech compresses the main spring between the hammer and the spring stop, and further slides the breech seal to seal to engage the gas valve. Actuation of the cocking pawl releases the hammer, which is driven by the main spring to impact the breech seal, which impacts the gas valve to release compressed gas and discharge the projectile from the muzzle.

In a specific embodiment, the foregoing apparatus further includes a trigger assembly coupled to the cocking pawl, which is disabled from releasing the cocking pawl unless the cocking member has been urged toward the breech to sealably engage the breech seal with the gas valve.

In a specific embodiment of the foregoing apparatus, the breech seal is slidably coupled to the cocking member, and further includes a seal spring disposed between the cocking member and the breech seal, which urges the breech seal against the gas valve. In a refinement to this embodiment, an elastomeric seal is placed between the breech seal and the gas valve.

In a specific embodiment of the foregoing apparatus, the spring stop position with respect to the cocking tube is adjustable, which enables adjustment of the main spring compression.

In a specific embodiment, the foregoing apparatus further includes a magnet disposed on the receiver, and the cocking lever is held in place by the magnet while the cocking member is urged toward the breech.

In another specific embodiment of the foregoing apparatus, the cocking member has a tubular form and is positioned concentric with the barrel. In a refinement to this embodiment, the hammer has a tubular form and is positioned to slide along the barrel exterior and the cocking member interior together with the main spring. In another specific embodiment, the breech seal has a substantially tubular form with a cylindrical interior that is sealed to the barrel with an elastomeric seal.

The present disclosure also teaches a compressed gas gun apparatus for discharging a projectile, which includes a barrel with a muzzle and a breech that is fixed to a receiver that has a breech opening adjacent to the breech. A gas valve is located adjacent to the breech opening and aligned with the barrel. A trigger with a cocking pawl is fixed to the receiver. A cocking member slides in parallel with the barrel, and has a spring stop fixed thereto. A cocking lever is rotatably coupled to the receiver at a first end and is coupled to the cocking member by a cocking link to provide a mechanical advantage to slide the cocking member. Opposing directions of rotation of the cocking lever selectively urges the cocking member towards the muzzle or toward the breech. A breech seal slides together with the cocking member, and sealably engages the barrel adjacent to the breech. A hammer and a main spring are located between the breech seal and the spring stop. Urging the cocking member toward the muzzle slides the breech seal away from the gas valve and exposes the breech within the breech opening, to facilitate insertion of the projectile into the breech, and also slides the hammer toward the muzzle to engage the cocking pawl and retain the hammer. Urging the cocking member toward the breech compresses the main spring between the hammer and the spring stop, and also slides the breech seal to seal the gas valve. Actuation of the trigger releases the hammer from the cocking pawl, which is driven by the main spring to impact the breech seal to further impact the gas valve, to thereby release compressed gas and discharge the projectile from the muzzle.

In a specific embodiment of the foregoing apparatus, the trigger assembly is disabled from releasing the cocking pawl unless the cocking member has been urged toward the breech to seal the breech seal with the gas valve.

In a specific embodiment of the foregoing apparatus, the breech seal is slidably coupled to the cocking member, and the apparatus further includes a seal spring between the cocking member and the breech seal, which urges the breech seal against the gas valve.

In a specific embodiment of the foregoing apparatus, the spring stop position with respect to the cocking tube is adjustable, which enables adjustment of compression of the main spring.

In a specific embodiment, the foregoing apparatus further includes a magnet disposed on the receiver, and the cocking lever location while the cocking member is urged toward the breech is maintained by magnetic attraction.

In a specific embodiment of the foregoing apparatus, the cocking member has a tubular form and is positioned concentric with the barrel. In a refinement to this embodiment, the hammer has a tubular form and is positioned to slide along the barrel exterior and the cocking member interior together with the main spring.

In a specific embodiment of the foregoing apparatus, the breech seal has a substantially tubular form with a cylindrical interior that is sealed to the barrel with an elastomeric seal.

DESCRIPTION OF THE INVENTION

Figure 1:
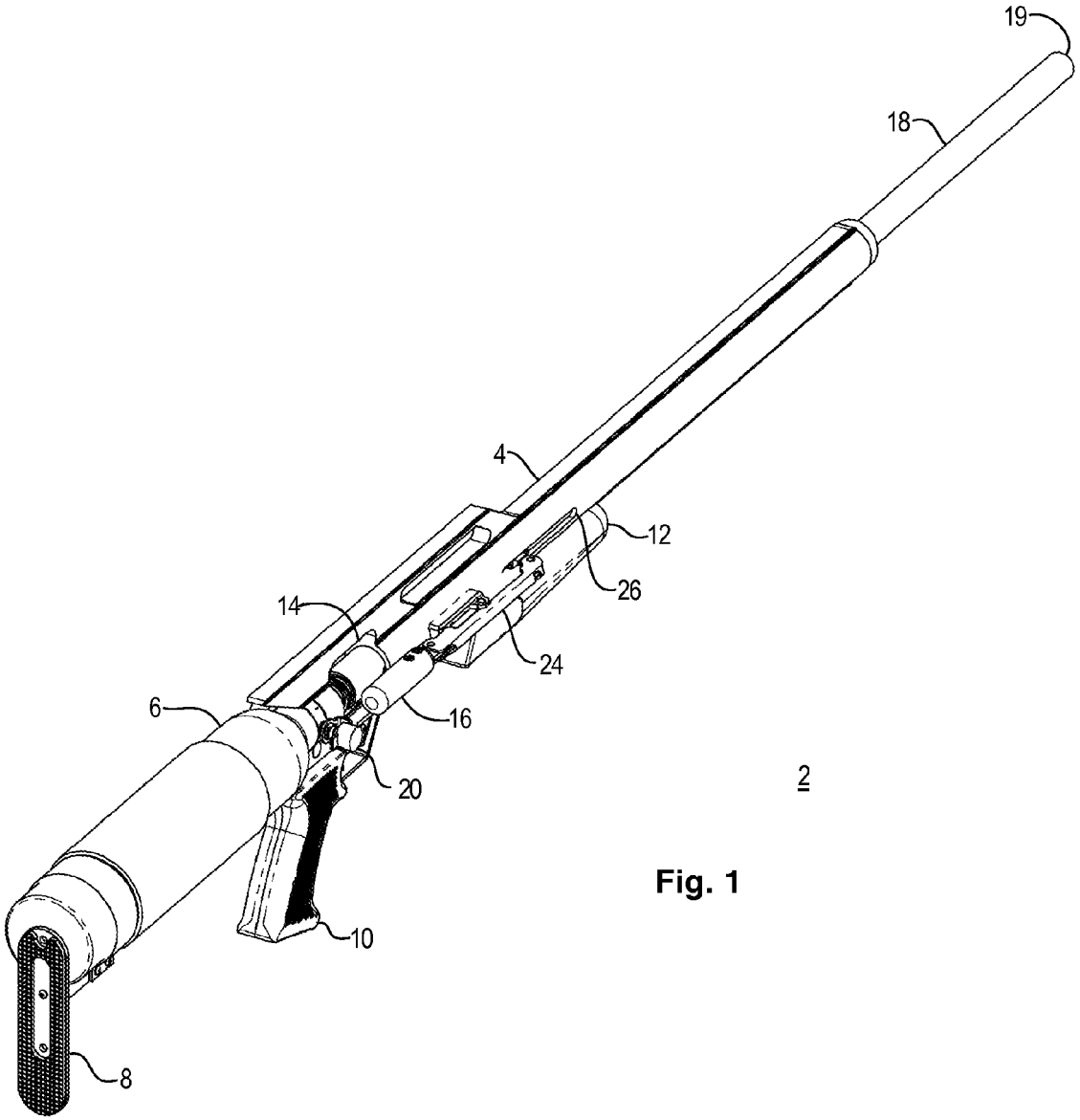
FIG. 1 is a perspective view drawing of an air gun according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods or components to form various apparatus and systems. Accordingly, the apparatus and system components and method steps have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

As was discussed in the Background section of this disclosure, the inventor hereof has been granted two prior art US patents, U.S. Pat. No. 5,586,545 issued on Dec. 24, 1996 for COMPRESSED GAS GUN, and U.S. Pat. No. 5,813,392 issued on Sep. 29, 1998 for COMPRESSED GAS GUN. These patents disclose compressed gas guns that employ loading, cocking and discharging mechanisms that perform well with light caliber projectiles, typically ranging from 0.17 inch to 0.25 inch calibers. In use, the operator of the gun follows a sequence of steps to load and discharge the gun, which generally proceeds as follows. Beginning from the condition where the gun as previously been discharged, the operator grasps a cocking handle and pushes a breech seal forward toward the muzzle, which exposes the breech end of barrel and pushes a hammer forward to compress a main spring until a cocking pawl engages the hammer in cocked position. Next, the operator inserts a projectile into breech end of barrel, and then pushes the breech seal rearward toward the breech end of the gun while the cocking pawl retains the hammer in the cocked position. The breech seal seals a gas release valve to the breech of barrel. Finally, the operator pulls a trigger, which releases the cocking pawl to allow the main spring to drive hammer rearward to impact the breech seal, which in-turn impacts the air release valve expelling air into the breech seal and barrel breech, thereby driving the projectile out of the muzzle of the barrel. Note that this configuration requires the operator to directly compress the main spring with the cocking handle.

The present disclosure provides novel loading, cocking, and discharging mechanisms for compressed gas guns that are particularly suitable for heavier calibers, although they are quite suitable for light calibers as well. According to certain illustrative embodiments of the present disclosure, the gun mechanism enables the operator to more easily and conveniently operate the compressed gas gun. In one embodiment, the operator grasps a cocking lever and pulls it away from the gun's receiver, which pushes an internal cocking tube forward toward the muzzle that also carries a breech seal and hammer forward to engage a cocking pawl of a trigger mechanism. Then, the operator closes the cocking lever and that pushes the cocking tube and breech seal rearward while the cocking pawl holds the hammer in forward position such that main string is compressed between a spring stop in cocking tube and the cocking pawl in trigger mechanism. The trigger is pulled to release cocking pawl, thereby allowing the hammer to be driven rearward into the breech seal, actuating an air valve and discharging a projectile. Another embodiment follows this sequence of events, which also begins with the gun in a previously discharged condition. The operator rotates a cocking lever that moves a cocking member within the gun's receiver. This action opens a breech seal to expose the barrel breech, and also urges a hammer and main spring forward until a coking pawl engages the hammer in forward position. The operator then inserts a projectile into breech end of barrel. Then, the operator rotates the cocking lever in the opposite direction to move the cocking tube rearward, which compresses the spring between a spring stop on the cocking member and a cocking pawl, and this action also closes that breech seal to seal an air release valve with barrel breech. Finally, the operator pulls a trigger to release the cocking pawl, which allows the main spring to drive hammer rearward to impact breech seal, which in-turn impacts the air release valve expelling air into the breech seal and barrel breech, thereby driving the projectile out of barrel and muzzle.

Reference is directed to FIG. 1, which is a perspective view drawing of a compressed gas gun 2 according to an illustrative embodiment of the present invention. The gun 2 is built about a receiver 4, which is an aluminum extrusion that is further machined in the illustrative embodiment. A barrel 18 is fixed to the receiver 4 with its muzzle 19 at the forward end of the gun 2. A pistol grip 10 and fore stock 12 are attached to the receiver 4 and are provided for operator convenience. A compressed gas cylinder 6 provides the energy source for the gun 2, and also functions as a shoulder stock, and further includes shoulder rest 8, also for operator convenience. A gas fill port 20 is provided so that the compressed gas cylinder can be refilled without disconnecting it from the receiver 4. A breech opening 14 is cut into the receiver, which provides operator access to the barrel breech (not shown) to facilitate loading of projectiles (not shown). A cocking lever 16 is rotatably connected to the receiver 4, and is also connected to a cocking link 24, which engages a cocking member (not shown) inside the receiver 4 through a cocking slot 26. The cocking lever 16, cocking link 24, and the cocking member (not shown) operate cooperatively to yield a mechanical advantage for the operator. A mechanical advantage is a measure of the force amplification achieved by using the cocking mechanism as a system. The cocking mechanism preserves the input power and trades off forces against movement to obtain a desired amplification in the output force. This is essentially the law of the lever, as will be appreciated by those skilled in the art. Machine components designed to manage forces and movement in this way are called mechanisms.

Figure 2:
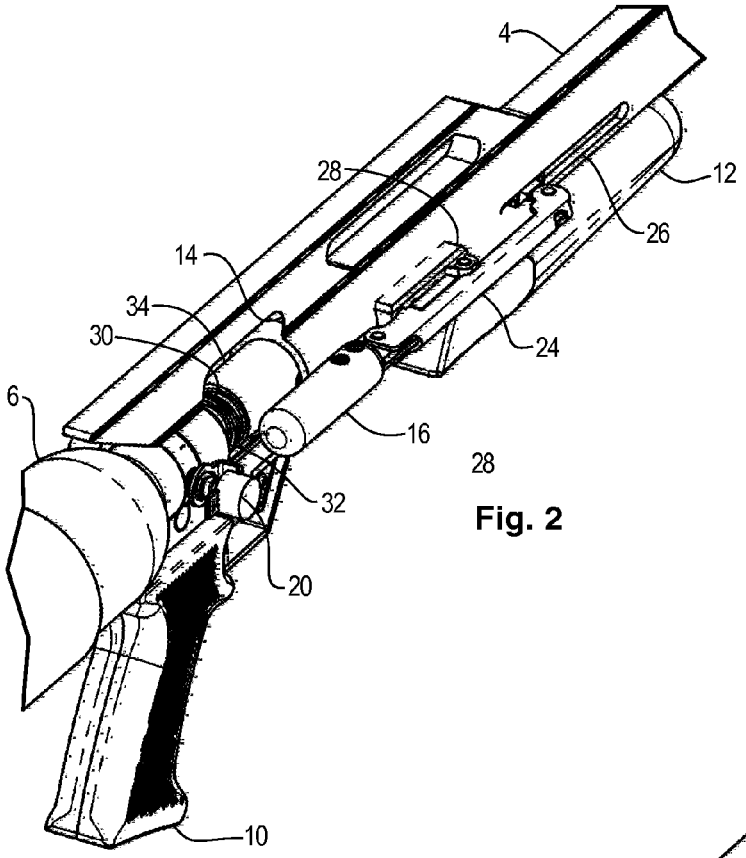
FIG. 2 is a perspective view drawing of an air gun with a breech seal in a closed position according to an illustrative embodiment of the present invention.
Figure 3:
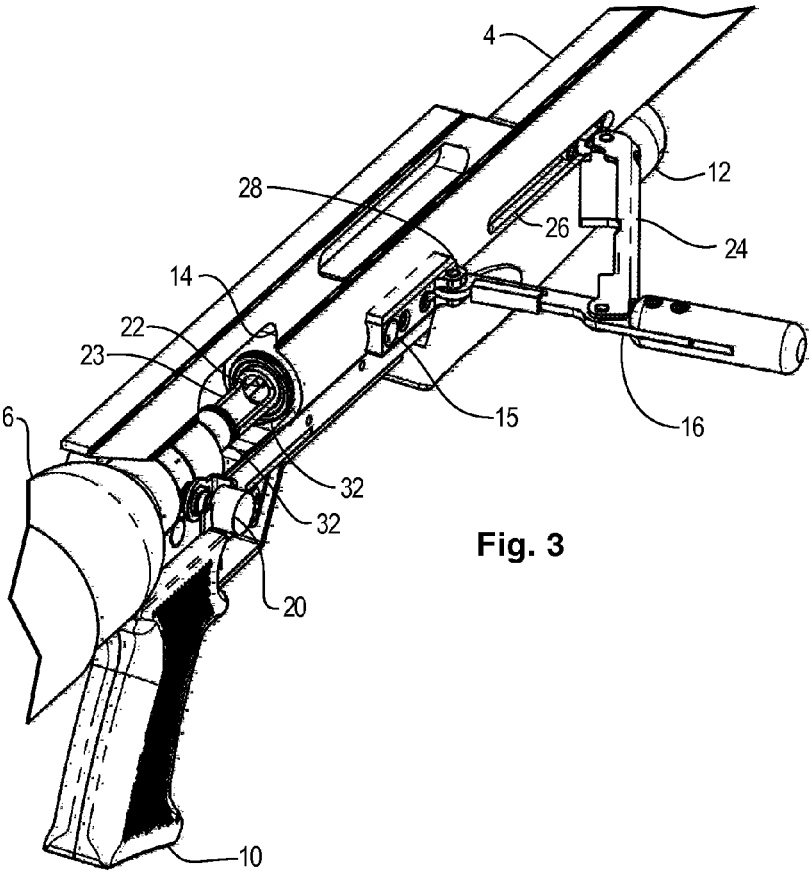
FIG. 3 is a perspective view drawing of an air gun with a breech seal in an open position according to an illustrative embodiment of the present invention.

Reference is directed to FIG. 2 and FIG. 3, which are partial perspective view drawings of a compressed gas gun with a breech seal in a closed position and opened position, respectively, according to an illustrative embodiment of the present invention. FIG. 2 corresponds to FIG. 1, but provides a closer view to facilitate the presentation of further details. Note that the receiver 4, pistol grip 10, fore stock 12 and gas cylinder 6 are presented. FIG. 2 presents a breech seal 30 in the closed position, and engaged with a gas valve 32. The breech seal 30 slides together with a cocking member 34, which is partially visible within the breech opening 14 in this condition. Note that the cocking handle 16 is positioned close to the receiver 4, which is a convenient location for carrying, discharging, and storing the gun. The cocking handle 16 is maintained in the closed position using a magnet (not shown) that is fixed to the receiver. The cocking link 24 is also held close to the receiver 4. The cocking link 24 engages a cocking member (not shown) through a cocking slot 26 formed in the receiver 4. The cocking handle 16 is rotatably coupled to the receiver 4 using a pivot mount 28.

FIG. 3 corresponds with FIG. 2, however FIG. 3 presents the gun with the cocking lever 16 rotated forward so as to urge the cocking member (not shown) and breech seal 30 toward the muzzle (not shown) to thereby expose the barrel breech 22 within the breech opening 14. The gas valve 32 is also more clearly visible in this condition. Note that the magnet 15 is fixed to the pivot mount 28, which serves to hold the cocking lever 16 in place against the receiver 4, as illustrated in FIG. 2. The cocking link 24 follows the cocking lever 16 as it is rotated toward the muzzle end the gun, and the distal end slides within the cocking slot 26 to advance the cocking member (not shown) inside the receiver 4. In the condition illustrated in FIG. 3, the operator has access to the breech 22 for insertion of a projectile. Note that the breech end 22 of the barrel is cut-away so that a projectile may rest thereupon as it is inserted into the breech 22. The projectile need not be fully inserted into the breech, rather just sufficiently to enable the compressed gas to force it into the barrel upon discharging the gun. Once a projectile is inserted, the operator rotates the charging handle 16 toward the breech end of the gun to return the gun to the same condition illustrate in FIG. 2. Further operations of the mechanisms will be more fully discussed hereinafter.

Figure 4:
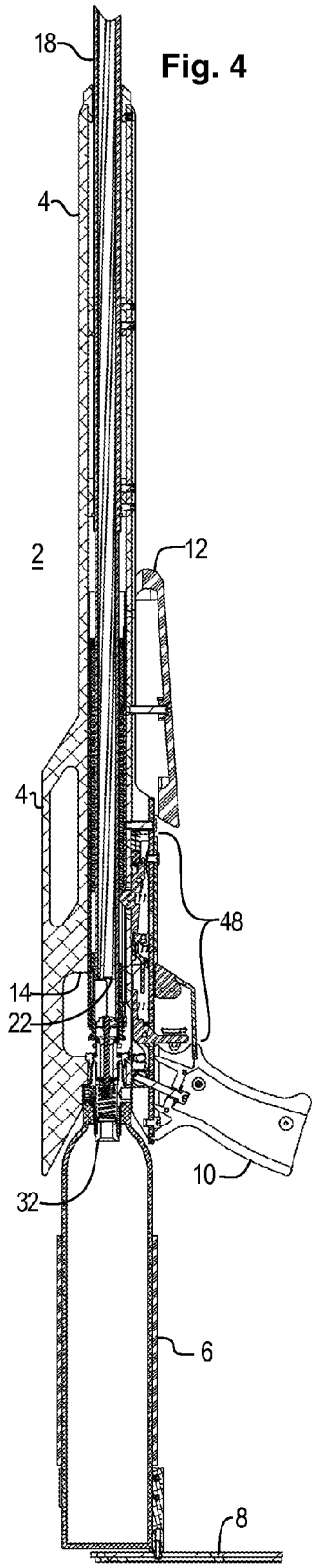
FIG. 4 is a section view drawing of an air gun according to an illustrative embodiment of the present invention.

Reference is directed to FIG. 4, which is a section view drawing of a compressed gas gun 2 according to an illustrative embodiment of the present invention. This view is a section taken through the centerline of an illustrative embodiment compressed gas gun 2, and serves to further orient the viewer with respect to other drawing figures and descriptive materials. The receiver 4 is an aluminum extrusion that is further machined to accommodate the various other components of the gun. The barrel 18 is fixed to the receiver 4. A breech opening 14 is formed into the receiver 4 to provided access to the breech 22 of the barrel. The pistol grip 10 and fore stock 12 are presented. The compressed gas cylinder 6 and shoulder stock 8 are also presented. The gas valve 32 is fixed to the gas cylinder 6 for expelling compressed gas into the breech 22 of the barrel 18. Note that a trigger assembly 48 is disposed in the lower portion of the receiver 4. The trigger assembly 48 includes a safety function in addition to the triggering function.

Figure 5:
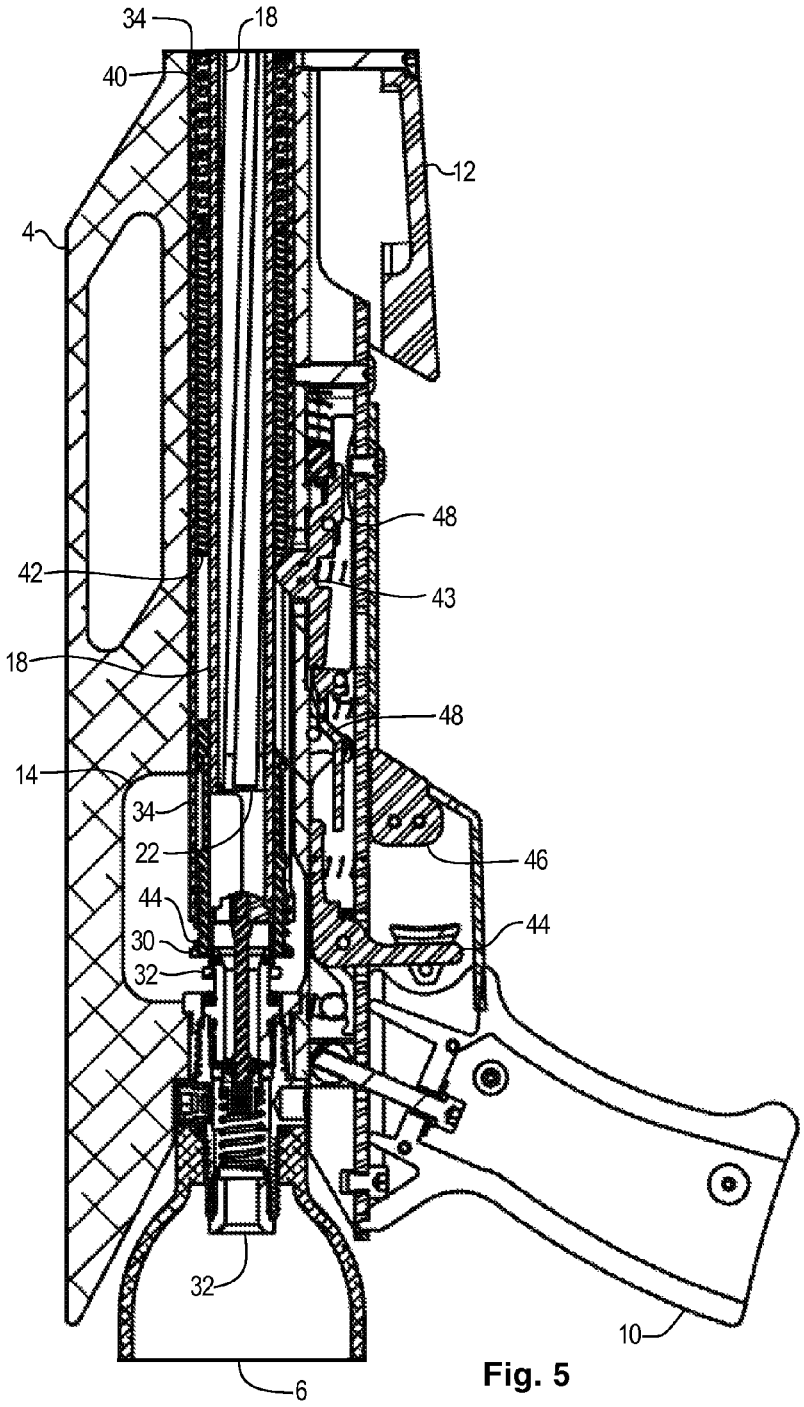
FIG. 5 is a detailed section view drawing of an air gun according to an illustrative embodiment of the present invention.

Reference is directed to FIG. 5, which is a detailed section view drawing of a compressed gas gun according to an illustrative embodiment of the present invention. FIG. 4 corresponds with FIG. 5 and is also a section view along the centerline, but is a closer view to reveal further details. In FIG. 4, the receiver 4, barrel 18, fore stock 12, pistol grip 10, and gas cylinder 6 are again presented. The gas valve 32 is fixed to the gas cylinder, and couples from the interior of the gas cylinder to a location within the breech opening 14, and is aligned with the breech 22 of the barrel 18, but spaced away so that there is sufficient space available to insert a projectile (not shown) into the breech 22. A number of components are located in the annual gap between the exterior of the barrel 18 and the interior of the receiver 4. Among these are, the cocking member 34, the breech seal 30, the breech spring 44, the hammer 42, and the main spring 40. All of these items are of cylindrical form and concentric with one another in the illustrative embodiment. This facilitates mutual support and location of these various components, and also yields a compact and lightweight design. However, the cylindrical and concentric arrangement is not required to implement a gun under the teachings of the present disclosure. Other configurations could be employed, and it is not required for all these components to be located within the receiver. For example, the hammer could be a pivoting member driven by a leaf spring, and the cocking member could be a bar located parallel to the barrel and outside of the receiver.

Continuing in FIG. 5, the trigger assembly 48, which is located in a lower recess of the receiver 4, further includes a trigger actuator 44 and a safety actuator 46 for implementing the convention functions of discharging the gun and interlocking against the discharge of the gun. A cocking pawl 43 engages the hammer 42 to retain the hammer 42 in position against the compressive force of the main spring 40 while the gun is cocked. When the trigger 44 is pressed, the cocking pawl 43 moves downward and releases the hammer 42 to be driven rearward toward the breech end of the gun by the main spring 40. The hammer 42 accelerates and impacts the breech seal 30, which functions as an energy communicating member to impact the gas valve 32 to release a pulse of compressed gas. The breech seal 30 sealably engages both the gas valve 32 and the barrel 18 so as to coupled the compressed gas energy to the barrel 18, rather than leaking away. Although, a small amount of leakage away from the intended pneumatic path is not problematic. Note that the cocking member 34, which is tubular in this embodiment, serves the function of carrying the moving components toward the muzzle or toward the breech as the cocking mechanism (not shown) is actuated. The moving members include the breech seal 30, the seal spring 44, the hammer 42, and the main spring 40, among certain other components that will be discussed hereinafter.

Figure 6:
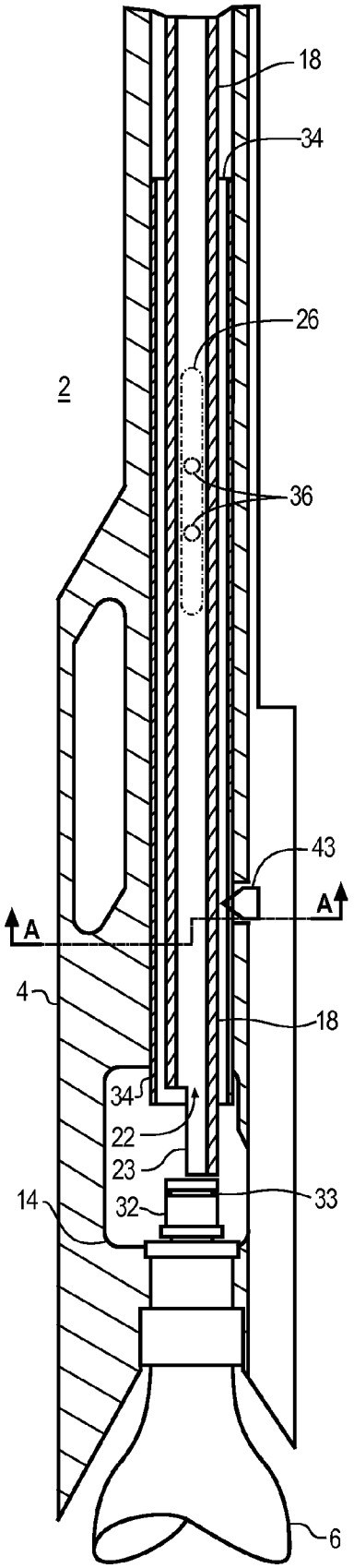
FIG. 6 is a detailed section view drawing of an air gun according to an illustrative embodiment of the present invention.
Figure 8B:
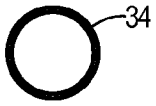
FIGS. 8A, 8B, 8C, and 8D are a bottom view drawing, an end view drawing, a right side view drawing, and a left side view drawing, respectively, of an air gun cocking tube according to an illustrative embodiment of the present invention.
Figures 8A, 8C, 8D:
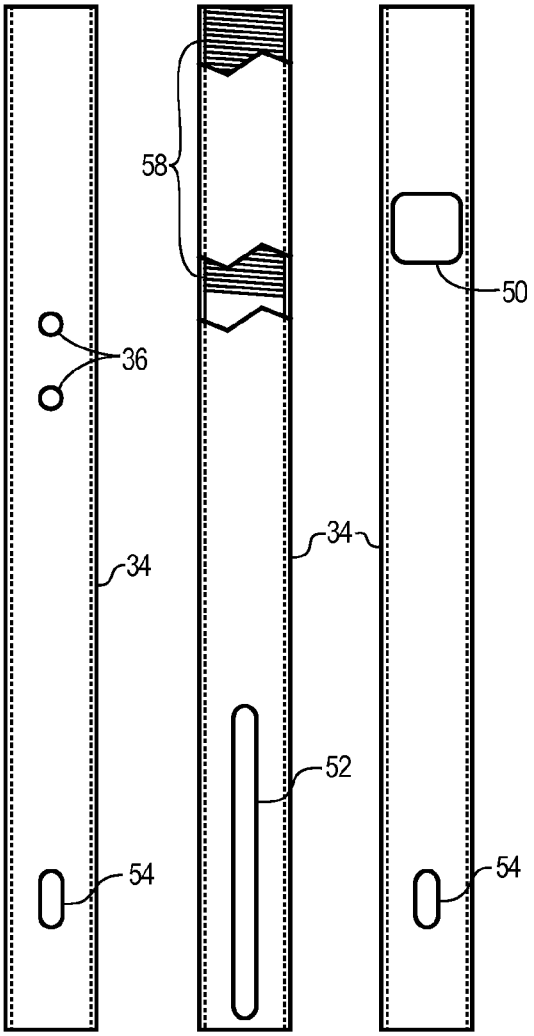

Reference is directed to FIG. 6, which is a detailed section view drawing of a compressed gas gun according to an illustrative embodiment of the present invention. This view of the illustrative embodiment gun 2 is presented with several of the internal components removed so that the location and arrangement of others is more readily discernable. The receiver 4 supports the barrel 18 in a fixed relationship. Note that the barrel is supported from the receiver 4 near the muzzle end using concentric collars (not shown) and sets screws (not shown), although other support arrangements could be employed. The fixed relationship is useful for aiming and accuracy of the gun 2 since the sights or scope are fixed to the receiver 4. The compressed gas cylinder 6 is fixed to the receiver 4 and presents the gas valve 32 in the breech opening 14 of the receiver 4. Note that an annular groove 33 is provided in the gas valve 32 for retaining an O-ring (not shown), which provides an elastomeric seal with the breech seal (not shown) when the two are sealably engaged. The gas valve 32 is concentrically aligned with the barrel 18 so that the breech seal (not shown) may slidable and sealably engage both of the barrel 18 and gas valve 32. The barrel breech 22 is visible in FIG. 6, and note the cut-away barrel extension 23 that extends rearward toward the gas valve 32. This extension 23 provides a trough into which the operator can rest a projectile (not shown) as it is pressed into the breech 22.

Another significant aspect of the illustrative embodiment of FIG. 6 is the location of the cocking slot 26 in the receiver 4. In this view, the cocking slot 26 is illustrated by phantom line because it is physically located on the portion of the receiver 4 removed for this section view. However, the position is correct with respect to the receiver 4 and cocking member 34. Also note the two mounting holes 36 that of formed in the cocking member 34 for engaging the cocking link (not shown) through the cocking slot 26. The mount holes 36 are illustrated in phantom line for the same reason. The cocking member 34 is tubular in this embodiment and it is enabled to slide fore and aft in the direction of the muzzle or breech ends of the barrel 18 as allowed by the length of the cocking slot 26 and urged by the cocking link (not shown). In this view, the cocking member 34 is illustrated at mid-travel between the two extremes. Note also the location of the cocking pawl 43, which passes through suitable apertures formed in both the receiver 4 and cocking member 34. The cocking pawl 43 is illustrated without the remaining components of the trigger assembly for the sake clarity.

Figure 7:
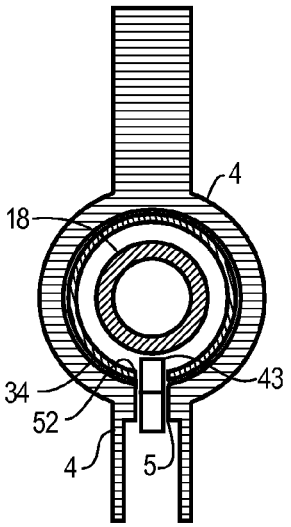
FIG. 7 is a cross section view drawing of an air gun according to an illustrative embodiment of the present invention.

Reference is directed to FIG. 7, which is a cross section view drawing of a compressed gas gun according to an illustrative embodiment of the present invention. This section view labeled "A-A" is taken from FIG. 6, at the location illustrated. In FIG. 7, the receiver 4 extrusion profile is visible with the barrel 18 at the center of the receiver 4. The cocking member 34 slides along the interior of the receiver 4, which serves as a guide for the sliding action. The cocking pawl 43 extends upwardly into the interior of the receiver 4 thought a suitable hole 5 in the receiver 4, and further through a suitable slot 52 in the cocking member 34. In this manner, the cocking pawl may be positioned within the interior of the cocking member 34 even thought the cocking member is slid for and aft. The annular space between the exterior of the barrel 18 and the interior of the cocking member 34 is provided to accommodate the breech seal (not shown), hammer (not shown) and the main spring (not shown).

Reference is directed to FIGS. 8A, 8B, 8C, and 8D, which are a bottom view drawing, an end view drawing, a right side view drawing, and a left side view drawing, respectively, of a compressed gas gun cocking member 34 according to an illustrative embodiment of the present invention. The cocking member 34 is in the form of a tube in this embodiment, which is open at both ends and slides along the interior of the receiver (not shown). The cocking member 34 has a slot 52 formed along its bottom, which provides access for the cocking pawl (not shown) to reach into its interior and engage the hammer (not shown). The cocking member includes a pair of opposing slots 54 on either side, and adjacent to the breech end, to facilitate connection of the breech seal (not shown). The cocking member 34 further includes a pair of mounting holes 36 on one side for connecting the cocking link (not shown), which drives the cocking member fore and aft during cycling of the gun. The interior of the muzzle end of the cocking member 34 is threaded 58 to engage and retain the spring stop (not shown). A spring stop adjustment port 50 is provided so that the spring stop (not shown) may be rotated to adjust its position, and thereby change the degree to which the main spring (not shown) is compressed during the cocking operation. The receiver 4 (not shown) has a corresponding spring stop adjustment opening for access by the operator.

Figure 9B:
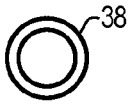
FIGS. 9A and 9B are a side view drawing and an end view drawing, respectively, of an air gun spring stop according to an illustrative embodiment of the present invention.
Figure 9A:
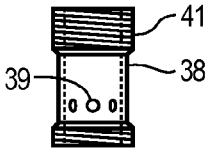

Reference is directed to FIGS. 9A and 9B, which are a side view drawing and an end view drawing, respectively, of a compressed gas gun spring stop 38 according to an illustrative embodiment of the present invention. Generally speaking, the spring stop is a fitment coupled to the cocking member, which engages the mainspring. The main spring is compressed between the spring stop and the hammer as the gun is cocked. The hammer is, in turn, retained by the cocking pawl. Thusly, release of the cocking pawl releases the hammer, which is accelerated under force of the mainspring. The cocking action is effected by the urging the cocking member against the main spring. The spring stop 38 of the illustrative embodiment in FIGS. 9A and 9B is generally tubular with exterior threads 41 to engage the corresponding threads in the cocking member (not shown). A series of holes 39 are formed around the circumference of the spring stop 38. These holes 39 are presented within the aforementioned spring stop adjustment ports (not shown) on the receiver (not shown) and cocking member (not shown). A suitable tool (not shown) can be used to engage the holes 39 to incrementally rotate the spring stop 38 on its threads 41 to vary its position with respect to the cocking member (not shown).

Figure 10:
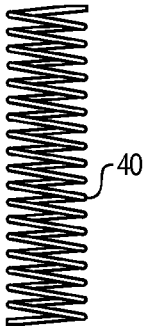
FIG. 10 is drawing of an air gun main spring according to an illustrative embodiment of the present invention.

Reference is directed to FIG. 10, which is drawing of a compressed gas gun main spring 40 according to an illustrative embodiment of the present invention. The main spring configuration is a coiled spring with tubular form that is specified according to the diameter, length, compressive force, and dimensions required for the gun caliber, hammer weight, and travel required, as will be appreciated by those skilled in the art. Other spring configurations can also be adapted to the teachings of the present invention.

Figure 11B:
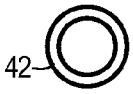
FIGS. 11A and 11B are a side view drawing and an end view drawing, respectively, of an air gun hammer according to an illustrative embodiment of the present invention.
Figure 11A:
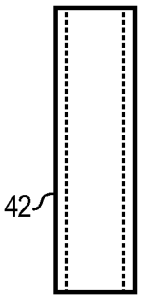

Reference is directed to FIGS. 11A and 11B, which are a side view drawing and an end view drawing, respectively, of a compressed gas gun hammer 42 according to an illustrative embodiment of the present invention. The hammer 42 of the illustrative embodiment is tubular in form having a length, diameter, and weight required for the physical configuration of the cocking assembly and driving force required for the air valve. Other hammer configurations could be adapted to the teachings of the present invention, as will be appreciated by those skilled in the art. The requisite functions of the hammer are that it can be retained by the cocking pawl and urged against the main spring.

Figure 12:
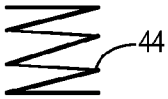
FIG. 12 is a drawing of an air gun breech seal spring according to an illustrative embodiment of the present invention.

Reference is directed to FIG. 12, which is a drawing of a compressed gas gun breech seal spring 12 according to an illustrative embodiment of the present invention. The breech seal spring 44 is slid over the breech seal (not shown) and engages the cocking member (not shown) so at to urge the breech seal away from the cocking member. In operation, as the cocking member is urged toward the gas valve, the breech seal engages the gas valve and is urges there against by the compressive force of the breech seal spring 44. Refer to the FIG. 5 for a graphical depiction of this arrangement.

Figure 13C:
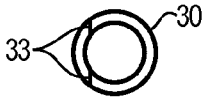
FIGS. 13A, 13B, and 13C are a side view drawing, a breech end view drawing, and a muzzle end view drawing, respectively, of an air gun breech seal according to an illustrative embodiment of the present invention.
Figure 13A:
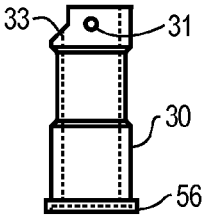
Figure 13B:
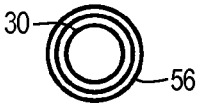

Reference is directed to FIGS. 13A, 13B, and 13C, which are a side view drawing, a breech end view drawing, and a muzzle end view drawing, respectively, of a compressed gas gun breech seal 30 according to an illustrative embodiment of the present invention. The breech seal 30 functions to sealably engage the barrel (not shown) and the gas valve (not shown) to provide a pneumatic path for compressed gas to be forced into the barrel breech (not shown) and drive the projectile (not shown). Since the breach seal 30 must be moved away to facilitate loading a projectile, it is coupled to the cocking member (not shown) and slides together therewith. This coupling is facilitated using a pair of pin fasteners (not shown) inserted into a pair of holes 31 on either side of the breech seal 30. These pins slidable engage a pair of corresponding slot in the cocking member (see items 54 in FIG. 8C and FIG. 8D). The play inherent in aligning a pin with a slot is addressed through the use of the breech seal spring (see FIG. 12), which is disposed between the breech seal 30 and the cocking member (not shown). The breech end face 56 of the breach seal 30 engages the gas valve (not shown) and acts to transfer the force of the hammer (not shown) through the breech seal to the gas valve. Note that the breech seal includes a clearance chamfer 33 to clear the location of the cocking pawl (not shown). Details of the physical arrangement are presented in FIGS. 14A, 14B, and 14C, and are hereinafter described.

Figures 14A, 14B, 14C:
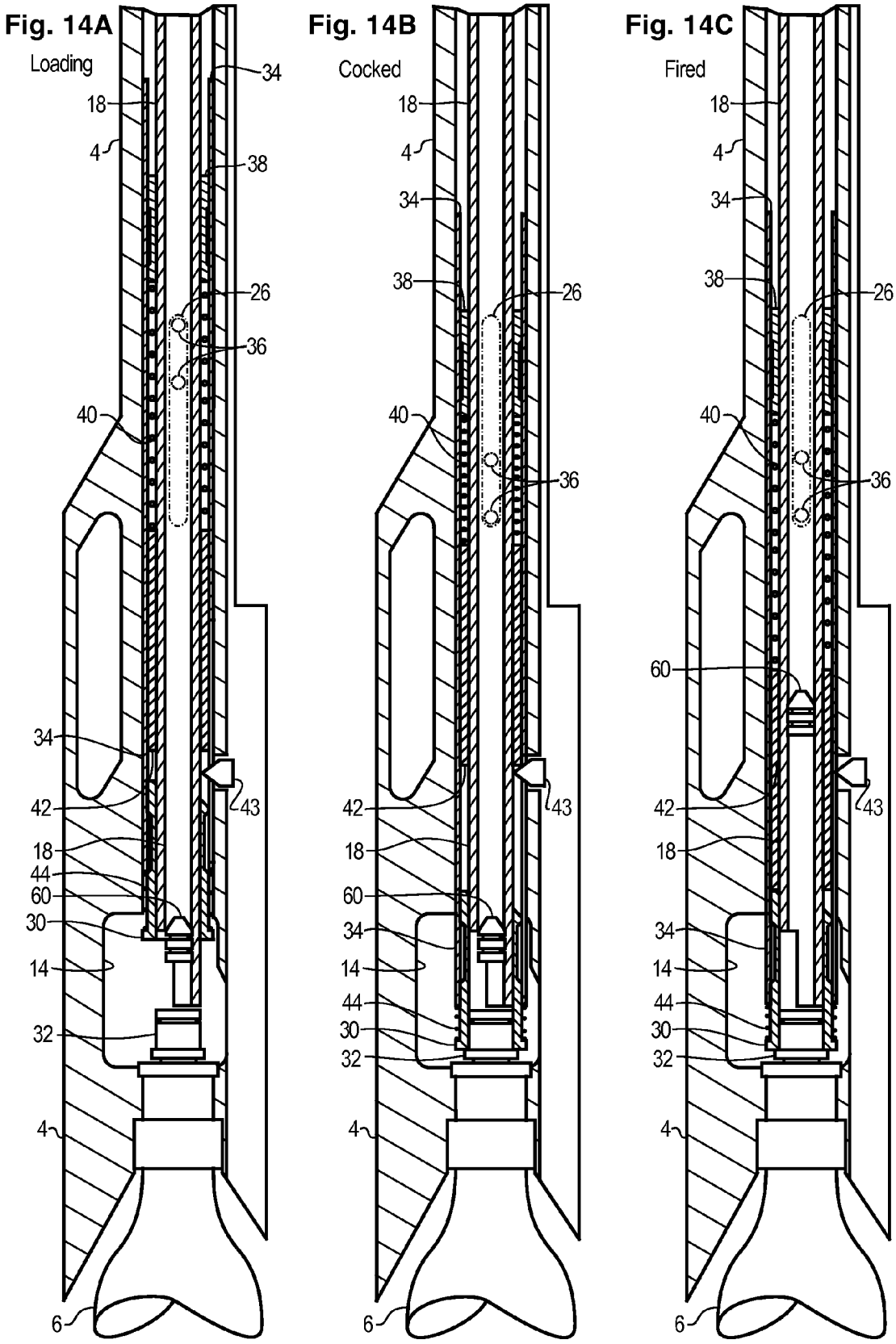
FIGS. 14A, 14B, and 14C are section view drawings of an air gun in the loading position, cocked position, and fired position, respectively, according to an illustrative embodiment of the present invention.

Reference is directed to FIGS. 14A, 14B, and 14C, which are section view drawings of a compressed gas gun in a loading position, a cocked position, and a fired position, respectively, according to an illustrative embodiment of the present invention. These drawings will assist the in understanding the sequence of actions in operating the gun and the interrelation of the various component parts. The receiver 4 with barrel 18 fixed thereto, barrel breech 22, breech opening 14, gas cylinder 6, and gas valve 32 are again presented. The cocking pawl 43 portion of the trigger assembly location is shown. Note the cocking slot 26 in the receiver 4 is again illustrated in phantom line since it is actually removed by virtue of the section view geometry. So too are the cocking assembly mounting holes 36 in the cocking member 34 shown in phantom. It is important to understand that the actuation of the mechanisms presented herein are effected by operation of the cocking mechanism (not shown), which are presented in FIG. 2 and FIG. 3. Thus, the driving force in the operation of the cocking mechanisms is input through the cocking mechanism holes 36 in the cocking member 34, which may be urged either toward the muzzle end of the gun or toward the breech end of the gun.

There are several components slidably located along the length of the barrel 18. These include, beginning from the muzzle end of the barrel 18, the spring stop 38, the main spring 40, the hammer 42, and the breech seal 30. The cocking member 34 is slidably disposed between these several items, excepting the spring stop 38, and the interior of the receiver 4. The spring stop 38 is threadably engaged with the cocking member 34. Note also that the breech seal 32 movement with respect to the cocking member 34 is limited to the length of the opposing slots (items 54 in FIG. 8C and FIG. 8D). Thusly, as the cocking tube us urged between the muzzle end position and the breach end position by the cocking mechanism (not shown), the breach seal 32, hammer 40, main spring 42, and spring stop 38 are also urged to slide together therewith, subject to the spacing between each of them and their connection to the cocking member 34. In the sequence discussion to follow, note that the cocking pawl 43 is enabled to selectively retain an release the hammer 40 under control of the trigger mechanism (not shown).

FIG. 14A illustrates the gun in a condition where it has been loaded by the operator, but not yet cocked. Note that the cocking mechanism (not shown) has urged the cocking member 34 toward the muzzle end of the gun and the cocking pawl 43 has been urged inward by the trigger mechanism (not shown). Note that the cocking mechanism holes 36 in the cocking member 34 are advanced as far as possible toward the muzzle end of the cocking slot 26 in the receiver 34. Also note that the operator has inserted a projective 60 into the breech of the barrel 18. In this condition, the cocking pawl blocks the reward movement of the hammer 42, but the main spring is relaxed due the extended distance between the spring stop 38 and the hammer 42.

FIG. 14B illustrates the gun in the cocked position. The gun is cocked by actuation of the cocking mechanism (not shown), which urges the cocking member 34 toward the breech end of the gun. Note that the cocking mechanism holes 36 in the cocking member 34 are advanced as far as possible towards the breech end of the cocking slot 26 in the receiver 34. As the cocking member 34 is advanced toward the breech end, the spring stop 38 applies force against the mains spring 40, which applies force against the hammer 42. However, since the hammer 42 is retained by the cocking pawl 43, the main spring 40 must compress to accommodate movement of the spring stop 38. Thusly, the energy applied to the cocking mechanism (not shown) is stored in the main spring 40 by compression. The mechanical advantage, discussed hereinbefore, of the cocking mechanism (not shown) aides the operator in compressing the main spring 40. Also note that the movement of the cocking mechanism 34 toward the breech carries the breech seal 30 rearward such that it sealably engages the gas valve 32. This sealing action is assisted by compression of the breech seal spring 44. Elastomeric seals disposed between the barrel 18 and the breech seal 30, and disposed between the breech seal 30 and the gas valve 32 perfect a pneumatic pathway from the gas valve 32 to the breech of the barrel 18. The gun is now ready to be discharged.

FIG. 14C illustrates the gun as it is discharged by actuation of the trigger mechanism (not shown), which drops the cocking pawl 43 away from the hammer 42. As this occurs, the energy stored in the main spring 40 is released and applied against the hammer 42, urging it toward the breech end of the gun. The hammer 42 accelerates and impacts the breech seal 30. Since the breech seal 30 is already engaged with the gas valve 32, the hammer 42 energy is immediately transferred to the gas valve, thereby "popping" the gas valve 32 and releasing a burst of compressed gas into the breech seal 30 and barrel 18. Of course, the gas pressure applies force against the projectile 60, and discharges it from the muzzle. The gas valve 32 immediately closes as soon as the spring forces and pressures balance between the interior of the gas cylinder 6 and the burst of gas behind the projectile 60.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A compressed gas gun apparatus for discharging a projectile, comprising:

a barrel, having a muzzle and a breech, fixed to a receiver that supports a cocking pawl and a gas valve positioned adjacent to said breech;

a cocking member slidably disposed in parallel with said barrel, and having a spring stop fixed thereto;

a cocking lever rotatably coupled to said receiver at a first end and coupled to said cocking member by a cocking link to thereby provide a mechanical advantage to slide said cocking member, and wherein opposing directions of rotation of said cocking lever selectively urges said cocking member towards said muzzle or toward said breech;

a breech seal coupled to slide together with said cocking member, and configured to sealably engage said barrel adjacent to said breech;

a hammer and a main spring disposed between said breech seal and said spring stop, and wherein rotation of said cocking lever to urge said cocking member toward said muzzle slides said breech seal away from said gas valve to facilitate insertion of the projectile into said breech, and further urges said hammer to engage said cocking pawl, thereby retaining said hammer, and wherein rotation of said cocking lever to urge said cocking member toward said breech compresses said main spring between said hammer and said spring stop, and further slides said breech seal to sealably engage said gas valve, and wherein actuation of said cocking pawl releases said hammer, which is driven by said main spring to impact said breech seal to further impact said gas valve, to thereby release compressed gas and discharge the projectile from said muzzle.

2. The apparatus of claim 1, further comprising:

a trigger assembly coupled to said cocking pawl, and wherein said trigger assembly is disabled from releasing said cocking pawl unless said cocking member has been urged toward said breech to sealably engage said breech seal with said gas valve.

3. The apparatus of claim 1, and wherein:

said breech seal is slidably coupled to said cocking member, and further comprising;

a seal spring disposed between said cocking member and said breech seal, and arranged to urge said breech seal against said gas valve.

4. The apparatus of claim 3, and further comprising an elastomeric seal disposed between said breech seal and said gas valve.

5. The apparatus of claim 1, and wherein:

said spring stop position with respect to said cocking tube is adjustable, thereby enabling adjustment of compression of said main spring.

6. The apparatus of claim 1, further comprising:

a magnet disposed on said receiver, and wherein said cocking lever location while said cocking member is urged toward said breech is maintained by magnetic attraction.

7. The apparatus of claim 1, and wherein:

said cocking member has a tubular form and is positioned concentric with said barrel.

8. The apparatus of claim 7, and wherein:

said hammer has a tubular form and is positioned to slide along said barrel exterior and said cocking member interior together with said main spring.

9. The apparatus of claim 1, and wherein:

said breech seal has a substantially tubular form with a cylindrical interior that is sealed to said barrel with an elastomeric seal.

10. A compressed gas gun apparatus for discharging a projectile, comprising:

a barrel, having a muzzle and a breech, fixed to a receiver having a breech opening adjacent to said breech;

a gas valve positioned adjacent to said breech opening and aligned with said barrel;

a trigger assembly fixed to said receiver, having a cocking pawl;

a cocking member slidably disposed in parallel with said barrel, and having a spring stop fixed thereto;

a cocking lever rotatably coupled to said receiver at a first end and coupled to said cocking member by a cocking link to thereby provide a mechanical advantage to slide said cocking member, and wherein opposing directions of rotation of said cocking lever selectively urges said cocking member towards said muzzle or toward said breech;

a breech seal coupled to slide together with said cocking member, and configured to sealably engage said barrel adjacent to said breech;

a hammer and a main spring disposed between said breech seal and said spring stop, and wherein rotation of said cocking lever to urge said cocking member toward said muzzle slides said breech seal away from said gas valve and exposes said breech within said breech opening, to thereby facilitate insertion of the projectile into said breech, and further slides said hammer toward said muzzle to engage said cocking pawl and retain said hammer, and wherein rotation of said cocking lever to urge said cocking member toward said breech compresses said main spring between said hammer and said spring stop, and further slides said breech seal to sealably engage said gas valve, and wherein actuation of said trigger assembly releases said hammer from said cocking pawl, which is driven by said main spring to impact said breech seal to further impact said gas valve, to thereby release compressed gas and discharge the projectile from said muzzle.

11. The apparatus of claim 10, and wherein:

said trigger assembly is disabled from releasing said cocking pawl unless said cocking member has been urged toward said breech to sealably engage said breech seal with said gas valve.

12. The apparatus of claim 10, and wherein:

said breech seal is slidably coupled to said cocking member, and further comprising;

a seal spring disposed between said cocking member and said breech seal, and arranged to urge said breech seal against said gas valve.

13. The apparatus of claim 10, and wherein:

said spring stop position with respect to said cocking tube is adjustable, thereby enabling adjustment of compression of said main spring.

14. The apparatus of claim 10, further comprising:

a magnet disposed on said receiver, and wherein said cocking lever location while said cocking member is urged toward said breech is maintained by magnetic attraction.

15. The apparatus of claim 10, and wherein:

said cocking member has a tubular form and is positioned concentric with said barrel.

16. The apparatus of claim 15, and wherein:

said hammer has a tubular form and is positioned to slide along said barrel exterior and said cocking member interior together with said main spring.

17. The apparatus of claim 10, and wherein:

said breech seal has a substantially tubular form with a cylindrical interior that is sealed to said barrel with an elastomeric seal.

* * * * *